US010054896B2

(12) United States Patent
Takagi et al.

(10) Patent No.: US 10,054,896 B2
(45) Date of Patent: Aug. 21, 2018

(54) DRIVE TRANSMISSION DEVICE AND IMAGE FORMING APPARATUS INCLUDING SAME

(71) Applicants: Hiroaki Takagi, Kanagawa (JP); Kimiharu Yamazaki, Kanagawa (JP); Naoyuki Suido, Kanagawa (JP); Shogo Sakamoto, Kanagawa (JP)

(72) Inventors: Hiroaki Takagi, Kanagawa (JP); Kimiharu Yamazaki, Kanagawa (JP); Naoyuki Suido, Kanagawa (JP); Shogo Sakamoto, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 150 days.

(21) Appl. No.: 15/181,854

(22) Filed: Jun. 14, 2016

(65) Prior Publication Data

US 2017/0010576 A1 Jan. 12, 2017

(30) Foreign Application Priority Data

Jul. 10, 2015 (JP) ..... 2015-139133

(51) Int. Cl.
*G03G 15/00* (2006.01)

(52) U.S. Cl.
CPC ..... *G03G 15/757* (2013.01)

(58) Field of Classification Search
CPC ..... G03G 15/757
See application file for complete search history.

(56) References Cited

U.S. PATENT DOCUMENTS 3,644,980 A * 2/1972 Class, Jr. ..... H05K 13/0491 219/201
5,984,835 A * 11/1999 Kawa ..... F16H 61/067 477/117
2012/0174573 A1* 7/2012 Skurkis ..... D07B 1/0673 60/527
2014/0356027 A1 12/2014 Yamazaki et al.
2015/0047459 A1 2/2015 Miyawaki et al.
2015/0053032 A1 2/2015 Yamazaki et al.
(Continued)

FOREIGN PATENT DOCUMENTS

JP 2001-193755 7/2001
JP 2007-040487 2/2007
JP 2007-240007 9/2007

*Primary Examiner* — David M Gray
*Assistant Examiner* — Geoffrey T Evans
(74) *Attorney, Agent, or Firm* — Harness, Dickey & Pierce, P.L.C.

(57) ABSTRACT

A drive transmission device includes a rotation shaft, a drive transmitter attached to the rotation shaft to slide in an axial direction and including an engaging portion extending in the axial direction, and a coil spring to bias the drive transmitter to one side in the axial direction, and a shaft-side drive transmitter disposed on the rotation shaft. The coil spring includes a sparse portion and a dense portion. The shaft-side drive transmitter engages the engaging portion to prevent the drive transmitter from disengaging from the rotation shaft. The coil spring and the engaging portion satisfy $$C>A-B$$

where A represents a length of the coil spring in a state in which the shaft-side drive transmitter retains the drive transmitter, B represents a compressed height of the coil spring, and C represents a length of the coil spring in the axial direction.

20 Claims, 8 Drawing Sheets

(56) References Cited

U.S. PATENT DOCUMENTS

| | | | | |
|---|---|---|---|---|
| 2015/0240879 | A1 | 8/2015 | Takagi et al. | |
| 2016/0062300 | A1* | 3/2016 | Takagi | F16D 1/10<br>464/157 |
| 2018/0074455 | A1* | 3/2018 | Takagi | G03G 21/186 |

* cited by examiner

DRIVE TRANSMISSION DEVICE AND IMAGE FORMING APPARATUS INCLUDING SAME

CROSS-REFERENCE TO RELATED APPLICATION

This patent application is based on and claims priority pursuant to 35 U.S.C. § 119(a) to Japanese Patent Application No. 2015-139133, filed on Jul. 10, 2015, in the Japan Patent Office, the entire disclosure of which is hereby incorporated by reference herein.

BACKGROUND

Technical Field

Embodiments of the present disclosure relate to a drive transmission device and an image forming apparatus including the same.

Description of the Related Art

There are image forming apparatuses employing process cartridges that include multiple rotators such as a photoconductor and a developing roller. Process cartridges are removably mounted in image forming apparatuses. Such image forming apparatuses include a drive transmission device to transmit a driving force from a driving source (or a driver) disposed in a body of the image forming apparatus to the multiple rotators of the process cartridge. The drive transmission device includes a driven-side coupling disposed at an end of a rotation shaft of the rotator and a drive-side coupling disposed on a drive output shaft disposed in the body. Thus, the rotation shaft of the rotator is coupled to the drive output shaft via the couplings.

SUMMARY

In an embodiment, a drive transmission device includes a rotation shaft, a drive transmitter attached to the rotation shaft to slide in an axial direction of the rotation shaft, a coil spring to bias the drive transmitter to one side in the axial direction, and a shaft-side drive transmitter disposed on the rotation shaft. The drive transmitter includes an engaging portion extending in the axial direction and is configured to transmit a drive force from the rotation shaft. The coil spring includes a sparse portion having a first winding pitch and a dense portion having a second winding pitch narrower than the first winding pitch. The shaft-side drive transmitter engages the engaging portion of the drive transmitter to prevent the drive transmitter from disengaging from the rotation shaft due to a biasing force of the coil spring. The coil spring and the engaging portion satisfy a relation defined as:

$$C>A-B$$

where A represents a length of the coil spring in a state in which the shaft-side drive transmitter retains the drive transmitter, B represents a compressed height of the coil spring being compressed to a degree that adjacent winding lines of the coil spring are in tight contact with each other, and C represents a length of the coil spring in the axial direction.

In another embodiment, an image forming apparatus includes the above-described drive transmission device.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
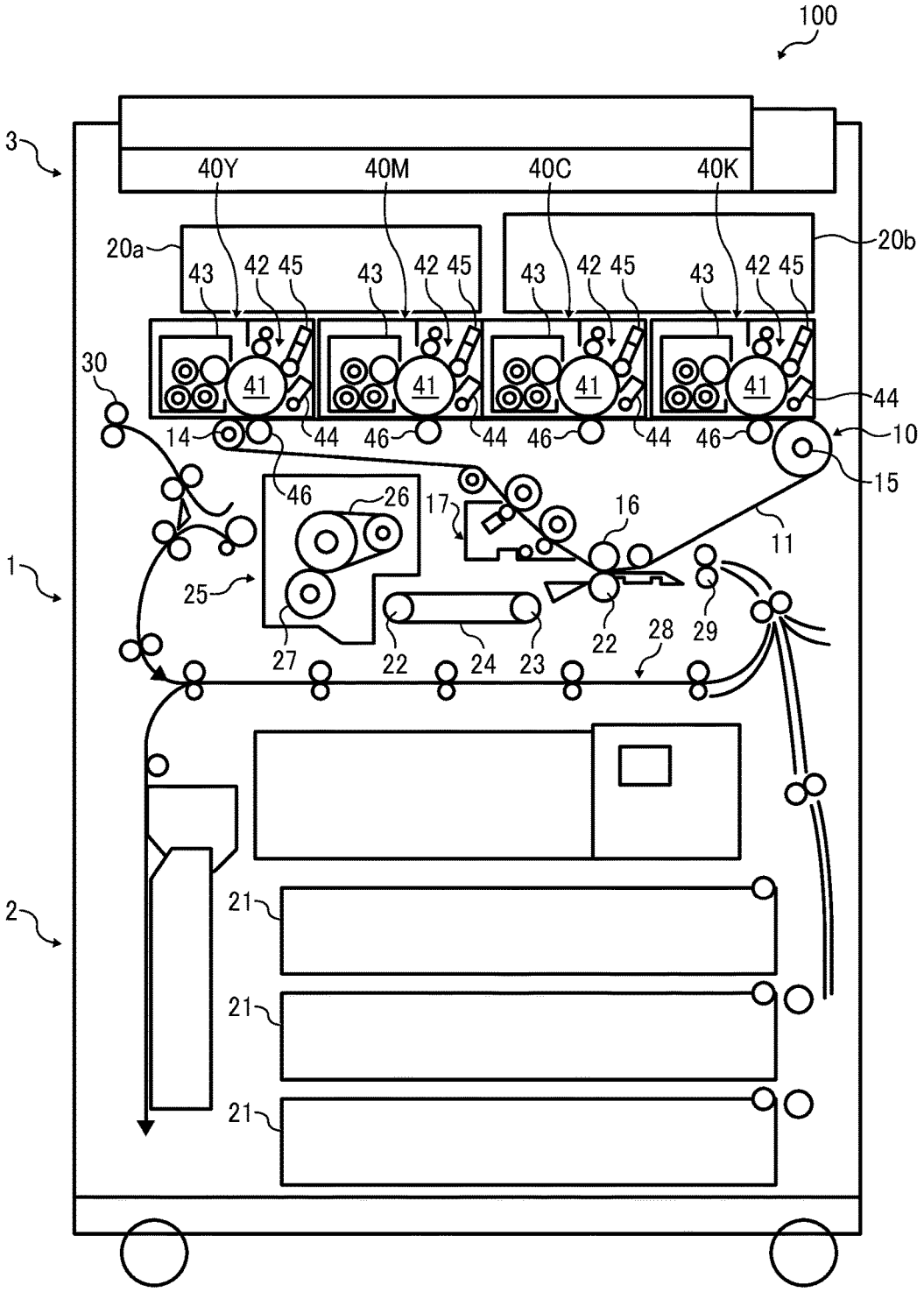
FIG. 1 is a schematic diagram illustrating a configuration of an image forming apparatus according to an embodiment.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, an image forming apparatus according to an embodiment is described.

FIG. 1 illustrates an image forming apparatus 100 according to the present embodiment. The image forming apparatus 100 is, for example, a digital multicolor copier having capabilities to scan a document to read image data of the document and digitize the image data to be used in image formation. Further, the image forming apparatus 100 has a facsimile capability (e.g., data transmission to and data reception from remote machines) and a printing capability to form images based on image data handled by computers.

The image forming apparatus 100 illustrated in FIG. 1 employs intermediate transferring in which an image is formed on a recording sheet (i.e., a recording medium) via an intermediate transfer belt 11. The image forming apparatus 100 employs electrophotography and a so-called tandem system including multiple process cartridges, each of which is dedicated for formation of different color toner images. A sheet feeder 2 of multistage-type is disposed in a bottom part of the image forming apparatus 100. An image forming section 1 is disposed above the sheet feeder 2, and a scanner 3 is disposed above the image forming section 1. The sheet feeder 2 includes multiple sheet feeding trays 21 stacked one on the top of another. Each of the sheet feeding trays 21 accommodates a bundle of recording sheets such as sheets of plain paper and overhead projector (OHP) transparency.

In a center part of the image forming section 1, a transfer device 10 is disposed. The transfer device 10 includes the intermediate transfer belt 11 (i.e., an endless belt) entrained around multiple rollers disposed inside the loop thereof. The intermediate transfer belt 11 rotates clockwise in FIG. 1. Above the intermediate transfer belt 11, four process cartridges 40Y, 40M, 40C, and 40K are disposed, side by side in the direction in which the intermediate transfer belt 11 rotates. The process cartridges 40Y, 40M, 40C, and 40K form yellow, magenta, cyan, and black toner images, respectively. It is to be noted that the suffixes M, C, Y, and K attached to each reference numeral indicate that components indicated thereby are used for forming magenta, cyan, yellow, and black images, respectively, and hereinafter may be omitted when color discrimination is not necessary. Above the four process cartridges 40, two latent-image writing devices, namely, optical writing units 20*a* and 20*b*, are disposed.

Figure 2:
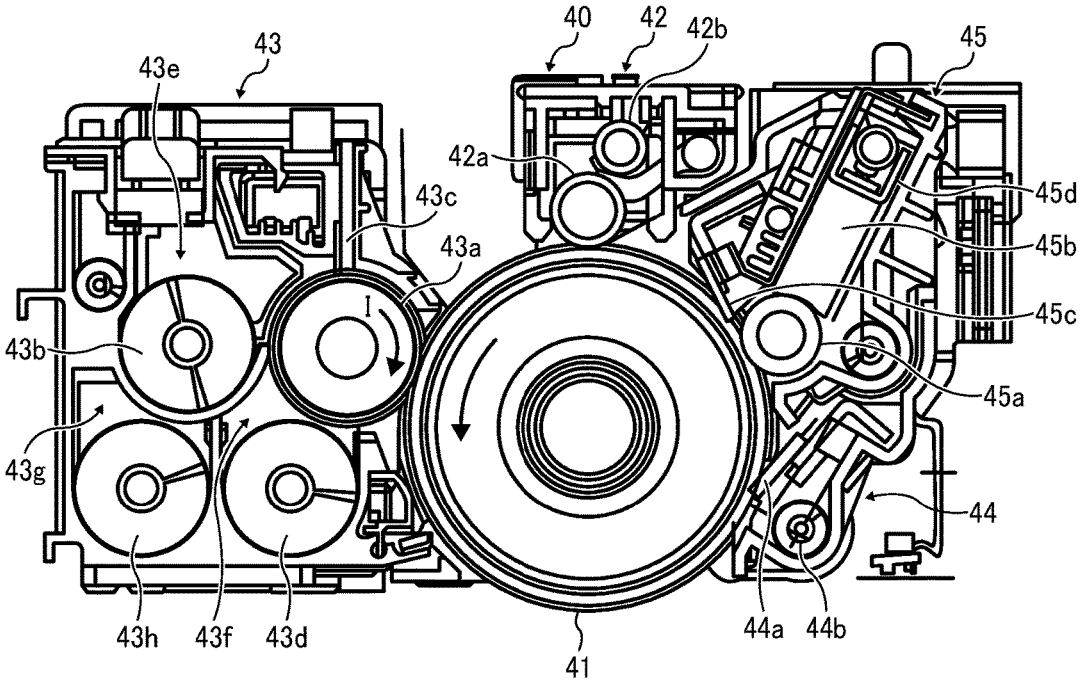
FIG. 2 is an enlarged view illustrating a process cartridge of the image forming apparatus illustrated in FIG. 1.

FIG. 2 is a schematic view illustrating a configuration of one of the process cartridges 40Y, 40M, 40C, and 40K.

Each process cartridge 40 includes a drum-shaped photoconductor 41 serving as a latent image bearer. The photoconductor 41 rotates counterclockwise in FIG. 1, and a charging device 42, a developing device 43, and a photoconductor cleaning device 44 are disposed around the photoconductor 41.

The charging device 42 includes a charging roller 42*a* disposed to abut or contact the photoconductor 41 and a roller cleaner 42*b* that rotates while abutting the charging roller 42*a*. A charging bias is applied to the charging roller 42*a*, and the charging roller 42*a* gives electrical charges to the surface of the photoconductor 41, thereby uniformly charging the photoconductor 41. The roller cleaner 42*b* removes substances, such as toner, adhering to the surface of the charging roller 42*a*.

The developing device 43 includes a developing roller 43*a*, serving as a developer bearer. The developing roller 43*a* supplies toner to an electrostatic latent image on the photoconductor 41, thereby developing the latent image, while rotating in the direction indicated by arrow I in FIG. 2. The developing device 43 further includes a supply screw 43*b* that transports developer from the back side to the front side in the direction perpendicular to the surface of the paper on which FIG. 2 is drawn while supplying the developer to the developing roller 43*a*. The supply screw 43*b* serves as a developer conveyor and includes a blade disposed on a rotation shaft thereof so as to transport the developer in the axial direction by rotating.

A developer doctor 43*c* is disposed downstream, in the direction of rotation of the developing roller 43*a*, from an opposing area where the developing roller 43*a* opposes the supply screw 43*b*. The developer doctor 43*c* serves as a developer regulator to adjust the thickness of the developer supplied to the developing roller 43*a* to a thickness suitable for developing. Further, a collecting screw 43*d* is disposed downstream, in the direction of rotation of the developing roller 43*a*, from a developing range where the developing roller 43*a* opposes the photoconductor 41. The collecting screw 43*d* collects the developer that has passed through the developing range (i.e., developer having been used in developing). The collecting screw 43*d* transports the collected developer in the direction identical to the direction in which the supply screw 43*b* transports the developer. The supply screw 43*b* is housed in a supply compartment 43*e* disposed on a lateral side of the developing roller 43*a*. Additionally, a collecting compartment 43*f* accommodating the collecting screw 43*d* is disposed below the developing roller 43*a*.

The developing device 43 further includes a stirring compartment 43*g* in which the developer is stirred and transported in the direction parallel to the direction in which the developer is transported in the collecting compartment 43*f*. The stirring compartment 43*g* is disposed below the supply compartment 43*e*. The stirring compartment 43*g* accommodates a stirring screw 43*h* to stir the developer and transports the developer to the back side of the paper on which FIG. 2 is drawn, which is the opposite direction from the direction in which the supply screw 43*b* transports the developer.

The supply compartment 43*e* is separated, at least partly, from the stirring compartment 43*g* by a first partition. Although separated by the first partition, the supply compartment 43*e* and the stirring compartment 43*g* communicate with each other through openings at both ends in the direction perpendicular to the surface of the paper on which FIG. 2 is drawn. It is to be noted that the first partition separates the supply compartment 43*e* from the collecting compartment 43*f* as well, but an opening is not provided to allow continuity between the supply compartment 43*e* and the collecting compartment 43*f*. Additionally, a second partition separates the stirring compartment 43*g* from the collecting compartment 43*f*. Although separated by the second partition, the stirring compartment 43*g* communicates with the collecting compartment 43*f* through an opening at the front end of the second partition in the direction perpendicular to the surface of the paper on which FIG. 2 is drawn.

After being adjusted by the developer doctor 43*c*, the developer on the developing roller 43*a* is transported to the developing range, where the photoconductor 41 is disposed opposite the developing roller 43*a*, and contributes to developing. After used in developing, the developer is collected in the collecting compartment 43*f* and transported from the back side to the front side in the direction perpendicular to the surface of the paper on which FIG. 2 is drawn. Then, the developer enters the stirring compartment 43*g* through the opening at the second partition. It is to be noted that toner is supplied to the stirring compartment 43*g* through a toner supply inlet disposed on an upper side of the stirring compartment 43*g*, positioned close to the opening at the upstream end of the second partition in the direction in which the developer is transported in the stirring compartment 43*g*.

In the supply compartment 43*e*, while supplying the developer to the developing roller 43*a*, the supply screw 43*b* transports the developer supplied from the stirring compartment 43*g* toward the downstream end in the direction in which the developer is transported in the supply compartment 43*e*. The developer that is not supplied to the developing roller 43*a* but is transported to the downstream end portion of the supply compartment 43*e* (i.e., excessive developer) is transported, through the opening (i.e., an excessive-developer opening) at the end of the first partition, to the stirring compartment 43*g*.

The collecting screw 43*d* transports the developer collected from the developing roller 43*a* in the collecting compartment 43*f* to a downstream end portion of the collecting compartment 43*f*, where the collected developer is transported to the stirring compartment 43*g* through the opening (i.e., a collected-developer opening) at the second partition. In the stirring compartment 43*g*, the stirring screw 43*h* mixes together and transports the excessive developer and the collected developer to a portion adjacent to the downstream end of the stirring compartment 43*g* in the developer conveyance direction therein, which is at the upstream end in the developer conveyance direction in the supply compartment 43*e*. Then, the developer enters the supply compartment 43*e* through the opening (i.e., a supply opening) at the first partition.

In the stirring compartment 43*g*, the stirring screw 43*h* transports the collected developer, the excessive developer, and the toner supplied, as required, from the toner supply inlet in the direction opposite the direction in which the developer is transported in the collecting compartment 43*f* and the supply compartment 43*e*. Subsequently, the developer is transported to the upstream end portion of the supply compartment 43*e* communicating with the downstream end portion of the stirring compartment 43*g*.

A toner concentration sensor is disposed adjacent to a position vertically below the supply opening at the downstream end of the stirring compartment 43*g* in the developer conveyance direction therein. According to outputs from the toner concentration sensor, a toner supply controller is driven to supply toner to the stirring compartment 43*g*.

The photoconductor cleaning device 44 includes an elastic cleaning blade 44*a* that is long in the axial direction of the photoconductor 41, a discharge screw 44*b*, and a lubrication device 45. A long side (contact side or an edge portion) of the cleaning blade 44*a* is pressed against the surface of the photoconductor 41 to remove substances, such as residual toner, from the surface of the photoconductor 41. The discharge screw 44*b* discharges the removed toner outside photoconductor cleaning device 44.

The lubrication device 45 mainly includes an application brush roller 45*a* to apply lubricant to the photoconductor 41, a solid lubricant 45*b*, and a leveling blade 45*c*. A bracket 45*d* holds the solid lubricant 45*b*, and a pressing member, such as a spring and a sponge, presses the solid lubricant 45*b* toward the application brush roller 45*a*. While rotating in the direction following the rotation of the photoconductor 41, the application brush roller 45*a* scrapes off powdered lubricant from the solid lubricant 45*b* and applies the lubricant to the photoconductor 41. An edge at a long side (contact side) of the leveling blade 45*c* is pressed against the surface of the photoconductor 41 to level off the lubricant from the surface of the photoconductor 41.

In FIG. 1, the transfer device 10 includes the intermediate transfer belt 11, a belt cleaning device 17, and four primary transfer rollers 46. The intermediate transfer belt 11 is entrained taut around multiple rollers including a tension roller 14, a driving roller 15, and a secondary-transfer backup roller 16 and rotates clockwise in FIG. 1 as the driving roller 15 rotates, driven by a belt driving motor.

The four primary transfer rollers 46 are disposed in contact with an inner face (inner circumference) of the intermediate transfer belt 11 and receive primary transfer biases from a power supply. The four primary transfer rollers 46 press the intermediate transfer belt 11 against the photoconductors 41 from inside the loop o the intermediate transfer belt 11, forming primary transfer nips therebetween. The primary transfer bias causes a primary-transfer electrical field between the photoconductor 41 and the primary transfer roller 46 in the primary transfer nip. The toner image is transferred from the photoconductor 41 onto the intermediate transfer belt 11 with the effects of the primary-transfer electrical field and the nip pressure.

The transfer device 10 further includes a secondary transfer roller 22, serving as a secondary transferor, disposed below the intermediate transfer belt 11. The secondary transfer roller 22 presses against the secondary-transfer backup roller 16 via the intermediate transfer belt 11. The secondary transfer roller 22 transfers the toner image from the intermediate transfer belt 11 onto the recording sheet fed between the secondary transfer roller 22 and the intermediate transfer belt 11. The belt cleaning device 17 is disposed downstream from the secondary-transfer backup roller 16 in the direction of rotation of the intermediate transfer belt 11. The belt cleaning device 17 removes the toner remaining on the surface of the intermediate transfer belt 11 after the toner image is transferred therefrom. The belt cleaning device 17 includes a lubrication device to lubricate the surface of the intermediate transfer belt 11.

A fixing device 25 is disposed downstream from the secondary transfer roller 22 in the direction of sheet conveyance. The fixing device 25 fixes the toner image on the recording sheet. A pressure roller 27 is pressed against an endless fixing belt 26. An endless conveyor belt 24 entrained around a pair of rollers 23 transports the recording sheet bearing the transferred toner image to the fixing device 25. Below the secondary transfer roller 22, a sheet reversing device 28 to reverse the recording sheet in duplex printing is disposed.

To make copies of a multicolor document using the image forming apparatus 100 configured as described above, the scanner 3 reads image data of the document set on an exposure glass. Additionally, while the intermediate transfer belt 11 rotates, different color toner image are formed on the respective photoconductors 41 through image forming process. The toner images are sequentially transferred from the photoconductors 41 and superimposed on one another on the intermediate transfer belt 11. Thus, a four-color toner image is formed on the intermediate transfer belt 11.

In parallel to formation of the four-color toner image on the intermediate transfer belt 11, the sheet feeder 2 feeds the recording sheets one by one from the sheet feeding trays 21 to a registration roller pair 29. Then, the recording sheet gets stuck in the nip of the registration roller pair 29 and stopped temporarily. The registration roller pair 29 start rotating, timed to adjust the position of the recording sheet relative to the four-color toner image on the intermediate transfer belt 11. As the registration roller pair 29 rotates, the recording sheet is again transported. Then, the secondary transfer roller 22 transfers the four-color toner image from the intermediate transfer belt 11 to a predetermined position on the recording sheet. Thus, a full-color toner image is formed on the recording sheet.

Subsequently, the recording sheet carrying the full-color toner image is transported to the fixing device 25 downstream from the secondary transfer roller 22 in the direction of sheet conveyance. The fixing device 25 fuses and fixes the full-color toner image on the recording sheet. A pair of ejection rollers 30 ejects the sheet bearing the fixed toner image outside the apparatus. In duplex printing to form images on both sides of the recording sheet, after a toner image is fixed on a first side of the recording sheet, the recording sheet is transported to the sheet reversing device 28, not the pair of ejection rollers 30. After the sheet reversing device 28 turns the recording sheet upside down, the recording sheet is transported again to the registration roller pair 29. While the recording sheet passes by the secondary transfer roller 22 and passes through the fixing device 25, a full-color image is formed on a second side of the recording sheet.

Figure 3:
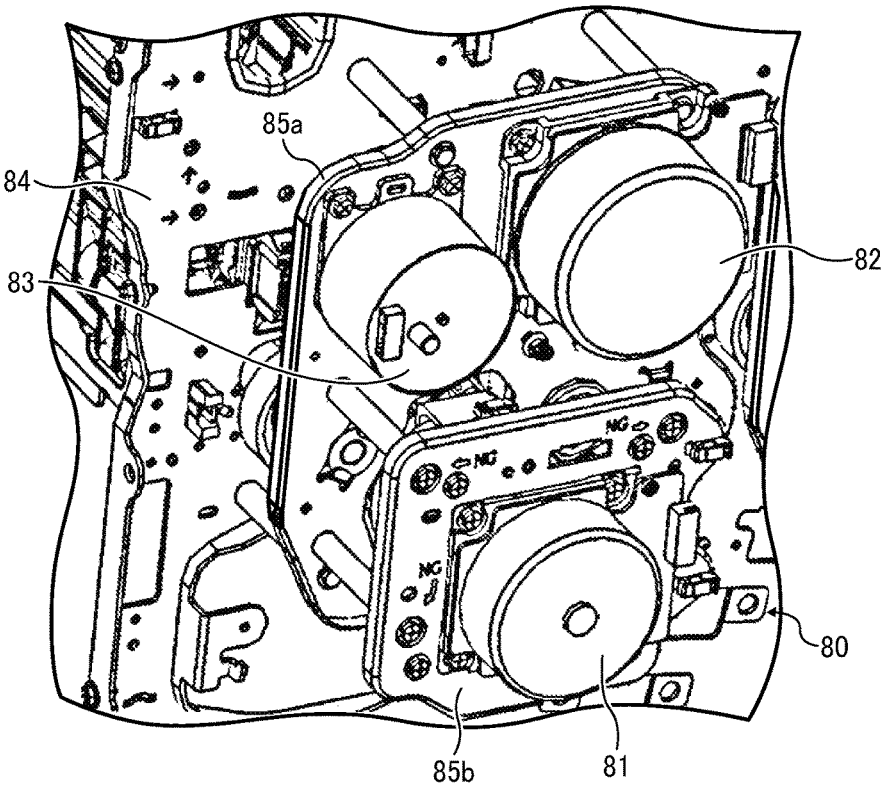
FIG. 3 is a perspective view of a driving device to drive the process cartridge illustrated in FIG. 2.

FIG. 3 is a perspective view of a driving device 80 to drive the process cartridge 40.

The driving device 80 includes a drum motor 81 to drive the photoconductor 41; a developing motor 82 to drive rotators of the developing device 43 such as the developing roller 43*a*, the supply screw 43*b*, the collecting screw 43*d*, and the stirring screw 43*h;* and a cleaning motor 83 to drive rotators of the lubrication device 45, such as the application brush roller 45*a* and the discharge screw 44*b*, as well as rotators of the photoconductor cleaning device 44. The developing motor 82 and the cleaning motor 83 are attached to a first motor mounting plate 85*a*. The first motor mounting plate 85*a* is attached to a back plate 84 of the apparatus. Specifically, the first motor mounting plate 85*a* is attached to an outer face of the back plate 84 opposite an inner face facing the process cartridge 40. The drum motor 81 is attached to a second motor mounting plate 85*b* attached to the first motor mounting plate 85*a*. The driving force from each of the drum motor 81, the developing motor 82, and the cleaning motor 83 is transmitted via gears and couplings to the rotators inside the process cartridge 40.

Figure 4:
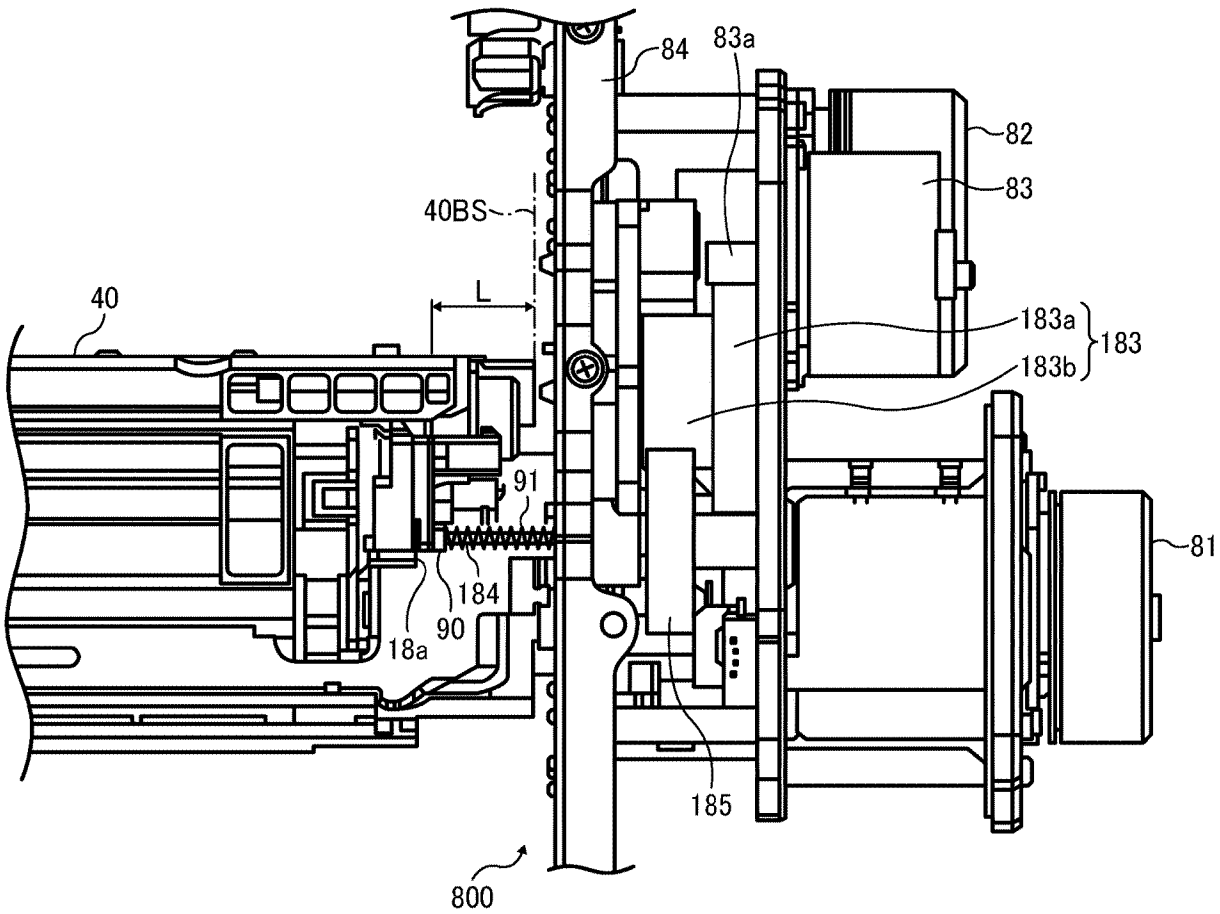
FIG. 4 is a front view of the driving device illustrated in FIG. 2 and the process cartridge illustrated in FIG. 3.

FIG. 4 is a front view of the driving device 80 and the process cartridge 40.

Figure 5:
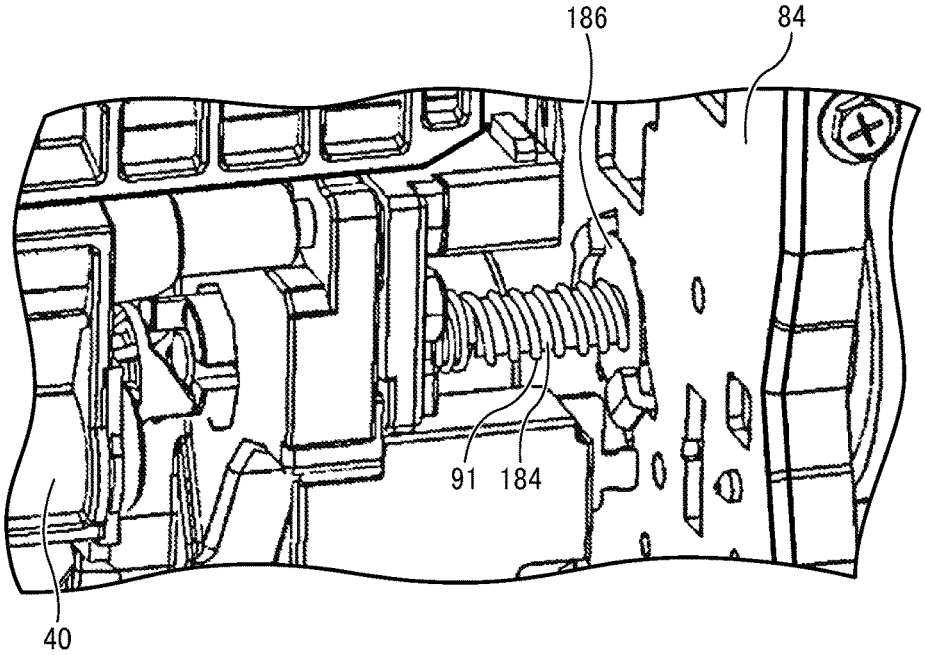
FIG. 5 is an enlarged perspective view of an area around a drive output shaft according to an embodiment.

FIG. 5 is an enlarged perspective view of an area around a drive output shaft 184 of a drive transmission device 800.

As illustrated in FIG. 4, the driving force from the cleaning motor 83 is transmitted by the drive transmission device 800 to the rotators of the lubrication device 45 and the photoconductor cleaning device 44. The drive transmission device 800 includes an idler gear assembly 183, an output gear 185, the drive output shaft 184, a joint 90, and a coil spring 91. The idler gear assembly 183 includes a first gear 183*a* to mesh with a motor gear 83*a* of the cleaning motor 83 and a second gear 183*b* to mesh with the output gear 185. The output gear 185 is attached to the drive output shaft 184 and rotates together with the drive output shaft 184.

The driving force of the cleaning motor 83 is transmitted via the idler gear assembly 183 and the output gear 185 to the drive output shaft 184. The drive output shaft 184 transmutes the driving force via the joint 90 to the application brush roller 45*a*. Then, the application brush roller 45*a* rotates.

Figure 6:
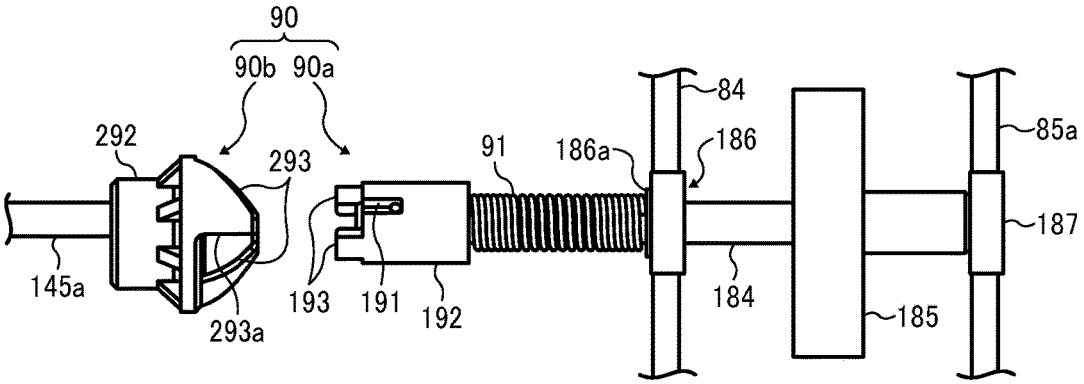
FIG. 6 is a schematic view illustrating an adjacent portion of the drive output shaft.

FIG. 6 is a schematic view of the drive output shaft 184 and a portion around the drive output shaft 184.

The drive output shaft 184 penetrates the back plate 84 and rotatably supported by the back plate 84 and the first motor mounting plate 85*a* via ball bearings 186 and 187. The joint 90 includes a drive-side coupling 90*a* (i.e., a drive transmitter) and a driven-side coupling 90*b*. The drive-side coupling 90*a* is attached to a first end of the drive output shaft 184 to slide in the axial direction of the drive output shaft 184. Meanwhile, the driven-side coupling 90*b* is attached to an end of a brush shaft 145*a* of the application brush roller 45*a*. The brush shaft 145*a* serves as a driven component to be rotated with the drive force transmitted from the drive output shaft 184 serving as the rotation shaft.

The drive-side coupling 90*a* includes a tubular part 192 into which the drive output shaft 184 is inserted. Two drive-side projections 193 project from an end of the tubular part 192 on the left in FIG. 6 (i.e., a process cartridge side). The drive-side projections 193 project in the axial direction of the tubular part 192 (or the drive-side coupling 90*a*) and are disposed at an interval of 180 degrees in the direction of rotation (in an arc shape) from each other. Additionally, the tubular part 192 has a slot 191 (i.e., a cutout) extending toward the back plate 84 from the left end (opposing the driven-side coupling 90*b*) in FIG. 6 of the tubular part 192. A parallel pin 184*a*, serving as a shaft-side drive transmitter, fits in the slot 191 serving as an engaging portion. The parallel pin 184*a* is disposed at the first end of the drive output shaft 184. The coil spring 91 biases the drive-side coupling 90*a* to the driven-side coupling 90*b*.

The driven-side coupling 90*b* includes a tubular part 292 into which the end of the brush shaft 145*a* is inserted. The end of the brush shaft 145*a* is cutout at two positions and is rounded rectangular (e.g., elliptical or oval) in cross section perpendicular to the axial direction. The inner circumference of the tubular part 292 (a through hole in the tubular part 292) is rounded rectangular as well. As the tubular part 292 is fitted around the end of the brush shaft 145*a*, the driven-side coupling 90*b* is attached to the brush shaft 145*a* so that the driven-side coupling 90*b* rotates together with the brush shaft 145*a*.

Two driven-side projections 293 project from an end of the tubular part 292 on the right in FIG. 6 (i.e., a driving device side). The drive-side projections 193 extend in the axial direction of the tubular part 292 (or the driven-side coupling 90*b*) and are disposed at an interval of 180 degrees in the direction of rotation (in an arc shape) from each other. Each driven-side projection 293 has a drive transmission face 293*a* that contacts or abuts the drive-side projection 193 of the drive-side coupling 90*a*. The driven-side projection 293 includes an inclined portion that gradually descends as the position withdraws from the drive transmission face 293*a* in the direction of rotation.

As the drive-side coupling 90*a* is coupled to the driven-side coupling 90*b*, the drive-side projections 193 of the drive-side coupling 90*a* oppose the drive transmission faces 293*a* of the driven-side projections 293 of the driven-side coupling 90*b* in the direction of rotation. As the drive output shaft 184 rotates receiving the driving force of the cleaning motor 83, the driving force is transmitted via the parallel pin 184*a* to the drive-side coupling 90*a*. Then, the drive-side coupling 90*a* rotates. As the drive-side coupling 90*a* rotates, the drive-side projections 193 contact the drive transmission faces 293*a* of the driven-side coupling 90*b* in the direction of rotation. Thus, the driven-side coupling 90*b* receives the driving force, and the application brush roller 45*a* rotates.

The coil spring 91 is disposed between the ball bearing 186 and the drive-side coupling 90*a* at the first end of the drive output shaft 184 and biases the drive-side coupling 90*a* to the driven-side coupling 90*b*. Specifically, a first end 91E1 (in FIG. 11B) of the coil spring 91 contacts or abuts an inner ring 186*a* of the ball bearing 186 into which the drive output shaft 184 is fitted. A second end 91E2 (in FIG. 11B) of the coil spring 91 contacts or abuts the right end (on the side of the back plate 84) in FIG. 6 of the tubular part 192 of the drive-side coupling 90*a*. The coil spring 91 is disposed between the ball bearing 186 and the drive-side coupling 90*a* in a compressed state. In the present embodiment, the parallel pin 184*a* contacts the right end (coil spring side) in FIG. 6 of the slot 191 and serves as a retainer to prevent the drive-side coupling 90*a* from slipping off the drive output shaft 184 due to the biasing force exerted by the coil spring 91.

In mounting of the process cartridge 40, when the driven-side projections 293 of the driven-side coupling 90*b* abut the drive-side projections 193 in the axial direction, the drive-side coupling 90*a* moves to the back side (to the back plate 84) while compressing the coil spring 91. With this action, the process cartridge 40 is mounted in the apparatus body even when the drive-side coupling 90*a* is not coupled to the driven-side coupling 90*b*. Subsequently, as the drive-side coupling 90*a* rotates, the driven-side projections 293 of the driven-side coupling 90*b* are disengaged from the drive-side projections 193 of the drive-side coupling 90*a*. Then, the drive-side coupling 90*a* moves to the driven-side coupling 90*b* due to the biasing force of the coil spring 91. With this action, the drive-side projections 193 of the drive-side coupling 90*a* oppose, in the direction of rotation, the drive transmission faces 293*a* of the driven-side projections 293 of the driven-side coupling 90*b*, and the drive-side coupling 90*a* is coupled to the driven-side coupling 90*b*. Then, the drive-side coupling 90*a* transmits the driving force to the driven-side coupling 90*b*.

Referring back to FIG. 4, a back face 18*a* of the photoconductor cleaning device 44 is shifted from a back end 40BS of the process cartridge 40 by a distance L to a front side of the apparatus. Accordingly, the amount by which the drive output shaft 184 extends from the back plate 84 is increased by the distance L. Consequently, the length of the coil spring 91 disposed between the ball bearing 186 and the drive-side coupling 90*a* is increased by the distance L. Thus, it is possible that component layout makes the distance between the component on which the first end 91E1 (in FIG. 11B9 of the coil spring 91 abuts to the coupling on which the second end 91E2 (in FIG. 11B) of the coil spring abuts long.

Figure 7:
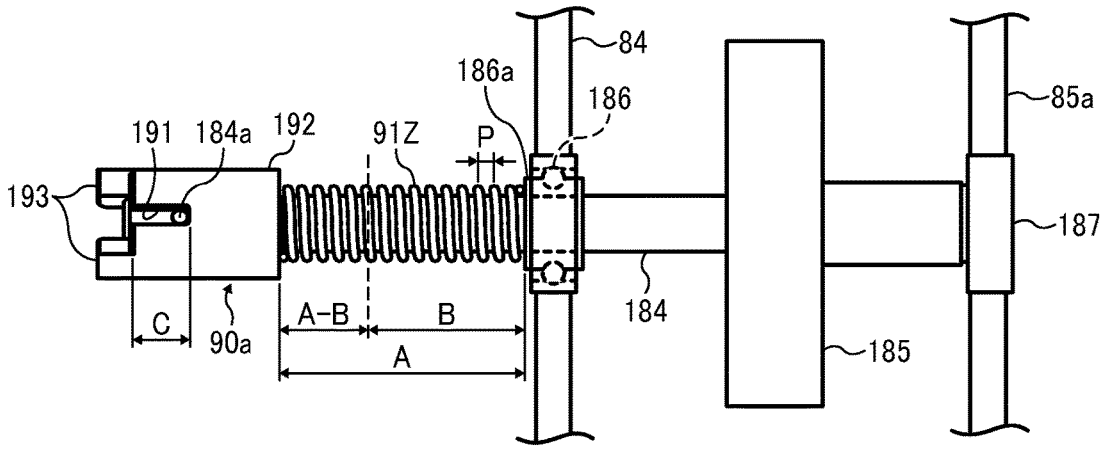
FIG. 7 is schematic view of a first comparative drive transmission device to transmit the driving force of a cleaning motor.

FIG. 7 is schematic view of a first comparative drive transmission device to transmit the driving force of the cleaning motor 83.

The first comparative drive transmission device illustrated in FIG. 7 includes a coil spring 91Z in which the wire is coiled at a uniform winding pitch P. In the comparative configuration illustrated in FIG. 7, a movable range of the drive-side coupling 90*a* to the back side (to the right in FIG. 7) is longer than a length C of the slot 191 in the axial direction of the drive output shaft 184 (or the direction in which the drive-side coupling 90*a* moves), and the inventors have found that it is possible that parallel pin 184*a* is disengaged from the slot 191. In FIG. 7, the coil spring 91Z has a predetermined length A in a state where the biasing force of the coil spring 91Z keeps the right end in FIG. 7 (i.e., a coil-side end) of the slot 191 in contact with the parallel pin 184*a*, and the parallel pin 184*a*, serving as the retainer, retains the drive-side coupling 90*a*. Further, the coil spring 91Z has a compressed height B in a state where the coil spring 91Z is compressed such that adjacent turns of the wire of the coil spring 91Z contact tightly each other. The movable range of the drive-side coupling 90*a* to the back side (to the right in FIG. 7) is obtained by deducting the compressed height B of the coil spring 91Z being compressed from the predetermined length of the coil spring 91Z.

Figure 8:
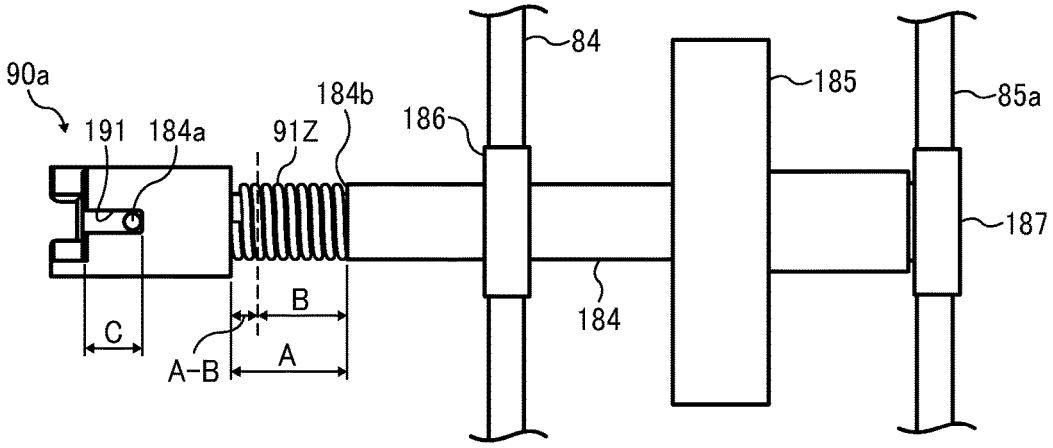
FIG. 8 is a schematic view of a second comparative drive transmission device.

FIG. 8 is a schematic view of a second comparative drive transmission device.

In the comparative configuration illustrated in FIG. 8, the drive output shaft 184 has a step 184*b* to have a reduced-diameter end. The step 184*b* is disposed closer to the drive-side coupling 90*a* than the ball bearing 186, and the first end of the coil spring 91Z is disposed in contact with the step 184*b*.

In the comparative configuration illustrated in FIG. 8, the predetermined length A is reduced compared with the configuration illustrated in FIG. 7, and the movable range (A-B) of the drive-side coupling 90*a* to the back side is made shorter than the length C of the slot 191 in the axial direction (C>A-B). In this configuration, before the parallel pin 184*a* is disengaged from the slot 191, the adjacent turns of the wire of the coil spring 91Z contact tightly with each other to the degree that the coil spring 91Z is not compressed further. Then, the drive-side coupling 90*a* is prevented from moving to the back side further. Consequently, the parallel pin 184*a* is prevented from disengaging from the slot 191.

It is to be noted that, in the configuration illustrated in FIG. 8, the end of the drive output shaft 184 is reduced in diameter by cutting or the like. Additionally, when a small-diameter shaft is used as the drive output shaft 184 to keep the apparatus compact, it is difficult to reduce the diameter of an end portion of the drive output shaft 184 to make the step 184*b*.

Figure 9:
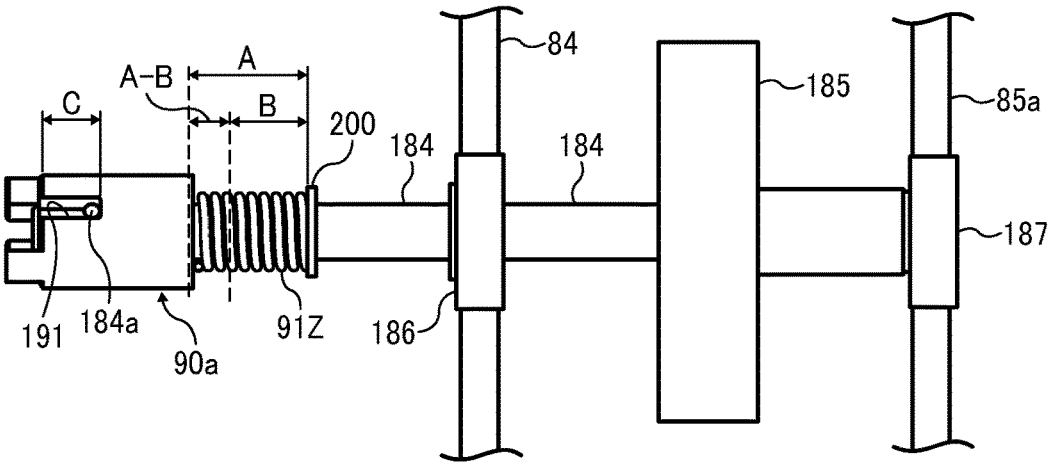
FIG. 9 is a schematic view of a third comparative drive transmission device.

FIG. 9 is a schematic view of a third comparative drive transmission device.

In the comparative configuration illustrated in FIG. 9, the drive output shaft 184 has a groove located closer to the drive-side coupling 90*a* than the ball bearing 186, and an E-ring 200 is fitted in the groove. The first end of the coil spring 91Z is disposed in contact with the E-ring 200.

In the comparative configuration illustrated in FIG. 9 as well, the predetermined length A is reduced compared with the configuration illustrated in FIG. 7, and the movable range (A−B) of the drive-side coupling 90*a* to the back side is made shorter than the length C of the slot 191 in the axial direction (C>A−B). Similar to the configuration illustrated in FIG. 8, the parallel pin 184*a* is prevented from disengaging from the slot 191.

It is to be noted that, in the configuration illustrated in FIG. 9, the groove in which the E-ring 200 is fitted is made in the drive output shaft 184 by cutting or the like. Use of the E-ring 200, however, means the increase in the number of components as well as the increase in the assembling process, resulting in a potential increase in the cost.

Another conceivable approach is to increase the length of the tubular part 192 of the drive-side coupling 90*a* to shorten the predetermined length A, thereby attaining the relation defined as C>A−B. However, the drive-side coupling 90*a* is disposed on the back side of the drive-side coupling 90*a*, and the access to the drive-side coupling 90*a* and replacement of the drive-side coupling 90*a* are not easy. Accordingly, in the present embodiment, the drive-side coupling 90*a* is made of sintered metal, the durability of which is enhanced. If the tubular part 192 is increased in length, the cost thereof increases.

Another conceivable approach is to increase the length C of the slot 191 of the drive-side coupling 90*a* to attain the relation defined as C>A−B. Increases in the length C can degrade the strength of the drive-side coupling 90*a*. To satisfy the relation defined as C>A−B while securing the strength, the tubular part 192 is increased in length. In this case, the cost increases.

Yet another conceivable approach is to increase the amount by which the brush shaft 145*a* projects from the back face 18*a* of the photoconductor cleaning device 44, thereby reducing the amount by which the drive output shaft 184 projects from the back plate 84. Then, the predetermined length A is shortened to satisfy the relation defined as C>A−B.

The process cartridge 40, however, is to be removed from the apparatus body. If the amount by which the brush shaft 145*a* projects from the back face 18*a* of the photoconductor cleaning device 44 is increased, there is a risk that something hits the brush shaft 145*a* to deform the brush shaft 145*a* in removal of the process cartridge 40 from the apparatus body.

Yet another conceivable approach is to reduce the winding pitch P to increase the number of turns of wire of the coil spring 91Z, thereby increasing the compressed height B of the compressed coil spring 91Z to satisfy the relation defined as C>A−B. In this case, however, the spring constant of the coil spring 91Z is degraded, weakening the biasing force to bias the drive-side coupling 90*a* toward the driven-side coupling 90*b*. Consequently, the drive-side coupling 90*a* pushed to the back side by the driven-side coupling 90*b* fails to smoothly move to the driven-side coupling 90*b* with the biasing force of the coil spring 91Z. At that time, there arises a risk of insecure coupling between the drive-side coupling 90*a* and the driven-side coupling 90*b*. Although the diameter of the coil wire can be increased to secure a predetermined spring constant even when the winding pitch P is reduced. In this case, the diameter of the coil spring 91Z increases. The increase in diameter of the coil spring 91Z increases the risk of interference between the coil spring 91Z and adjacent components.

In view of the foregoing, the present embodiment employs the coil spring 91 in which the winding pitch P is made uneven to keep the movable range of the drive-side coupling 90*a* shorter than the length C of the slot 191 (C>A−B).

Figure 10:
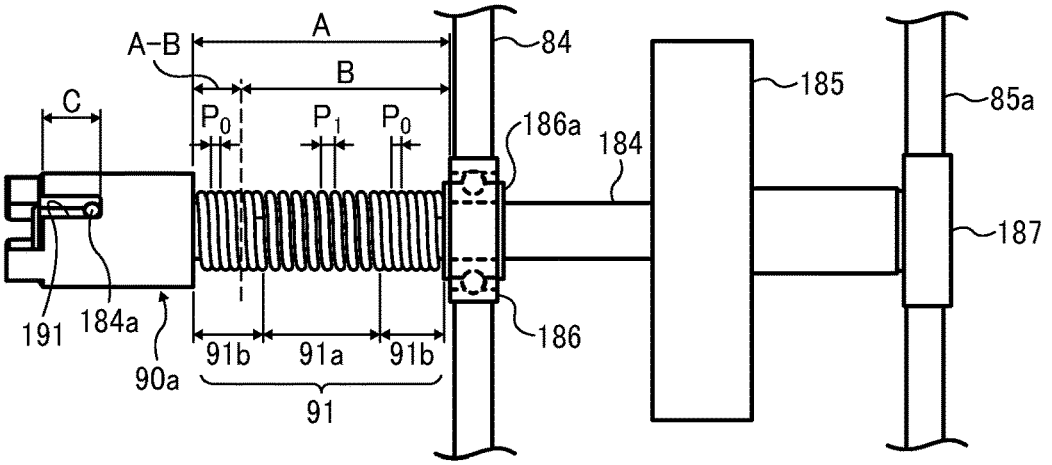
FIG. 10 is schematic view of a drive transmission device according to an embodiment, to transmit the driving force of the cleaning motor.

FIG. 10 is schematic partial view of the drive transmission device 800 to transmit the driving force of the cleaning motor 83, according to the present embodiment.

As illustrated in FIG. 10, the coil spring 91 according to the present embodiment is an uneven-pitch coil spring and includes a sparse portion 91*a* with a first winding pitch $P_1$ and dense portions 91*b* with a second winding pitch $P_0$ narrower than the first winding pitch $P_1$. In the present embodiment, the winding pitch $P_0$ of the dense portions 91*b* is identical or similar to the wire diameter of the coil spring 91 so that the adjacent turns of the wire contact with each other. The dense portions 91*b* do not have a spring capability. The first winding pitch $P_1$ of the sparse portion 91*a* is set to attain a spring constant to bias the drive-side coupling 90*a*.

Use of the unevenly pitched coil spring 91 is advantageous in suppressing the degradation of spring constant and increasing the number of turns of wire, thereby increasing the compressed height B of the coil spring 91 being compressed. With this configuration, the relation defined as C>A−B is attained. Since the diameter of the coil wire is not increased to attain the spring constant, the coil spring 91 is kept compact. Additionally, the relation defined as C>A−B is attained without cutting processing of the drive output shaft 184 or increases in the length of the tubular part 192 of the drive-side coupling 90*a*. Thus, increases in the cost of the device are suppressed. Additionally, the relation defined as C>A−B is attained without increasing the length C of the slot 191 of the drive-side coupling 90*a*. Accordingly, the durability of the drive-side coupling 90*a* is not sacrificed.

Although the coil spring 91 includes the dense portions 91*b* at both ends thereof in the configuration illustrated in FIG. 10, alternatively, the dense portion 91*b* can be disposed at one end of the coil spring 91. The number of turns of wire of the dense portion 91*b* is set to satisfy the relation defined as C>A−B. For example, the number of turns of wire of the dense portion 91*b* is three or greater in the present embodiment. This configuration is advantageous in that, even when the coil spring 91 is long, the coil spring 91 is stabilized in posture and easily attached to the drive output shaft 184.

In the present embodiment, the winding pitch $P_0$ of the dense portions 91*b* is identical or similar to the wire diameter of the coil spring 91 so that the adjacent turns of the wire contact with each other. What is intended is to make the winding lines of the wire contact with each other in a state in which the coil spring 91 is compressed and disposed between the drive-side coupling 90*a* and the ball bearing 186. That is, in a state in which the coil spring 91 is not compressed and has a free length, the winding lines of the wire can be contactless with each other.

The following inconvenience is possible if the winding lines are contactless with each other in the coil spring 91 compressed and disposed between the drive-side coupling 90*a* and the ball bearing 186. In an initial stage of movement of the drive-side coupling 90*a* to the back side, the dense portions 91*b*, which is smaller in spring constant than the sparse portion 91*a*, are compressed mainly. Thus, the force to bias the drive-side coupling 90*a* weakens. Consequently, it is possible that the coil spring 91 fails to push back the drive-side coupling 90*a* with the biasing force to the position where the parallel pin 184*a* contacts the back end of the slot 191. Then, the coupling between the drive-side coupling 90*a* and the driven-side coupling 90*b* becomes insecure.

By contrast, in the configuration in which the winding lines contact with each other in the coil spring 91 disposed between the drive-side coupling 90*a* and the ball bearing 186, the sparse portion 91*a* is compressed from the initial stage of movement of the drive-side coupling 90*a* to the back side. Then, the drive-side coupling 90*a* is biased with the spring constant of the sparse portion 91*a*. Accordingly, the coil spring 91 attains the biasing force to return the drive-side coupling 90*a* to the position where parallel pin 184*a* contacts the back end of the slot 191, and the drive-side coupling 90*a* is coupled to the driven-side coupling 90*b*.

FIGS. 11A, 11B, 11C, and 11D illustrate assembling of components on the drive output shaft 184.

Figure 11A:
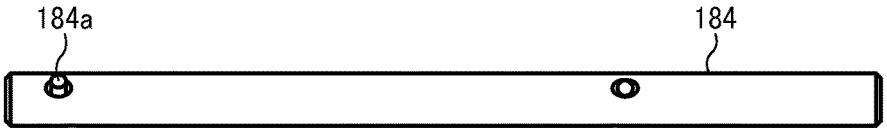
FIGS. 11A through 11D illustrate assembling of components on a drive output shaft according to an embodiment.
Figure 11B:
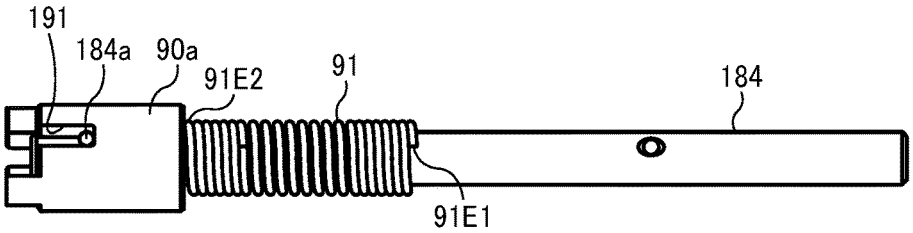

The components are attached to the drive output shaft 184 as follows. Referring to FIG. 11A, insert the parallel pin 184*a* into an insertion hole adjacent to the first end of the drive output shaft 184. Then, as illustrated in FIG. 11B, attach the drive-side coupling 90*a* to the drive output shaft 184 from the right in FIG. 11B, and fit the parallel pin 184*a* in the slot 191. Subsequently, attach the coil spring 91 to the drive output shaft 184 from the right in FIG. 11B.

Figure 11C:
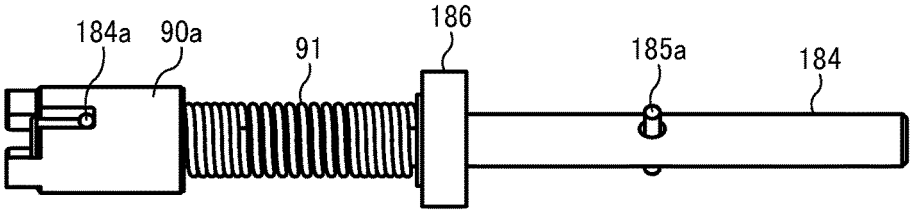
Figure 11D:
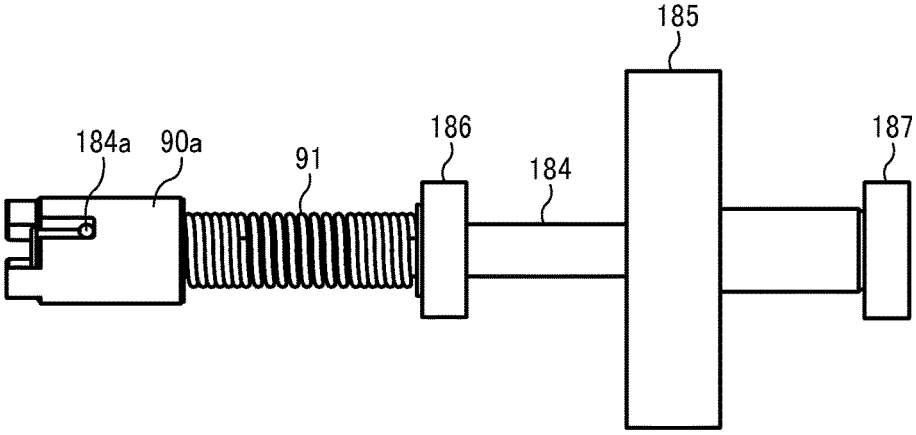

Then, as illustrated in FIG. 11C, attach the ball bearing 186 to the drive output shaft 184 and press the ball bearing 186 to the left in FIG. 11C until the coil spring 91 is compressed for a predetermined amount. Then, insert a coupling pin 185*a* into the drive output shaft 184. Subsequently, as illustrated in FIG. 11D, attach the output gear 185 to the drive output shaft 184 from the right in FIG. 11D, and fit the coupling pin 185*a* in a groove of the output gear 185. Attach a ball bearing 187 to a second end of the drive output shaft 184 opposite the first end.

In the present embodiment, the slot 191 of the drive-side coupling 90*a*, in which the parallel pin 184*a* is fitted, is shaped as a cutout and open on the side of the process cartridge 40. This shape has the following advantage compared with a long hole extending in the axial direction. In the case where the drive-side coupling 90*a* has a long hole extending in the axial direction to receive the parallel pin 184*a*, initially, the drive-side coupling 90*a* is attached to the drive output shaft 184. Subsequently, while the drive-side coupling 90*a* is held with the long hole of the drive-side coupling 90*a* aligned with the insertion hole adjacent to the first end of the drive output shaft 184, the parallel pin 184*a* is inserted therein. Thus, the insertion of the parallel pin 184*a* is not simple but requires alignment of the drive-side coupling 90*a*.

By contrast, in the present embodiment, since the parallel pin 184*a* is fitted in the slot 191 that is open on the side of the process cartridge 40, the drive-side coupling 90*a* can be attached to the drive output shaft 184 after the parallel pin 184*a* is inserted in the drive output shaft 184. This configuration facilitates insertion of the parallel pin 184*a*, thus facilitating the assembling of the components on the drive output shaft 184.

Additionally, in the present embodiment, the inner diameter of the tubular part 192 of the drive-side coupling 90*a* is greater than the outer diameter of the drive output shaft 184. This configuration enables smooth attachment of the drive-side coupling 90*a* to the drive output shaft 184, thereby facilitating the assembling. Similarly, the inner diameter of the coil spring 91 is greater than the outer diameter of the drive output shaft 184 to enable smooth attachment of the coil spring 91 to the drive output shaft 184, thereby facilitating the assembling.

Figure 12:
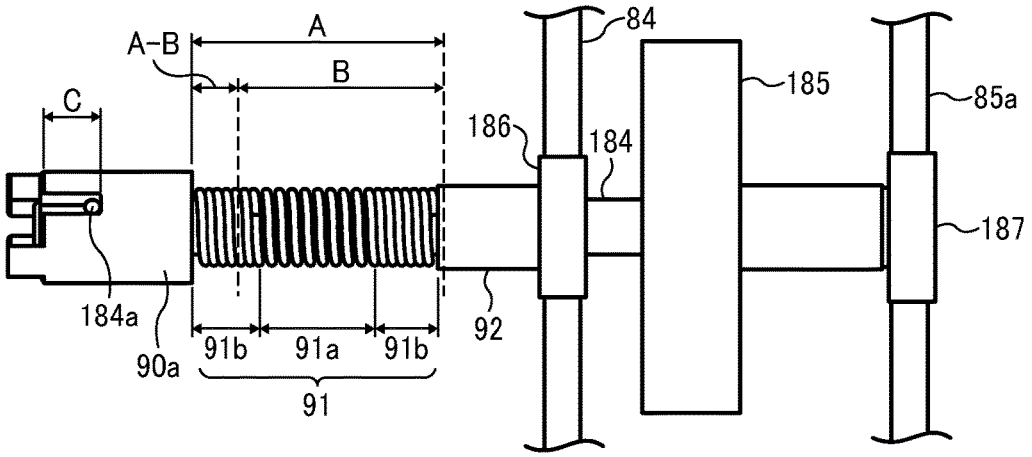
FIG. 12 is a schematic view of a drive output shaft and components attached thereto, according to another embodiment.

Additionally, in another embodiment illustrated in FIG. 12, a press-fit component 92 is interposed between the coil spring 91 and the ball bearing 186 so that the first end 91E1 of the coil spring 91 contacts or abuts the press-fit component 92. This configuration can shorten the predetermined length A and increase the compressed height B of the coil spring 91, thereby keeping the length C of the slot 191 longer than the movable range of the drive-side coupling 90*a* (C>A−B).

The various aspects of the present specification can attain specific effects as follows.

Aspect 1

Aspect 1 concerns a drive transmission device that includes a drive transmitter (e.g., the drive-side coupling 90*a*) attached to a rotation shaft (e.g., the drive output shaft 184) to slide in the axial direction of the rotation shaft and transmit a drive force from the rotation shaft. The drive transmitter includes an engaging portion (e.g., the slot 191) extending in the axial direction, and a shaft-side drive transmitter (e.g., the parallel pin 184*a*) disposed on the rotation shaft engages the engaging portion. The drive transmission device further includes a coil spring (e.g., the coil spring 91) to bias the drive transmitter to one side (to the left in FIG. 6) in the axial direction and a retainer (e.g., the parallel pin 184*a*) to prevent the drive transmitter from being disengaged from the rotation shaft due to a biasing force of the coil spring 91. The coil spring includes portions different in winding pitch from each other. The coil spring and the engaging portion satisfy a relation defined as C>A−B where A represents a length of the coil spring in a state in which the retainer retains the drive transmitter (in a state in which a coil spring side end of the engaging portion is in contact with the retainer), B represents a compressed height of the coil spring being compressed to a degree that adjacent turns of the coil wire are in tight contact with each other, and C represents a length of the coil spring in the axial direction.

A movable range (A−B) of the drive transmitter, such as the drive-side coupling 90*a*, is obtained by deducting the compressed height B of the coil spring 91 from the length A of the coil spring in the state in which the coil-side end of the engaging portion is in contact with the retainer and the retainer retains the drive transmitter. Accordingly, when the movable range (A−B) of the drive transmitter is shorter than the length C of the engaging portion (e.g., the slot 191) in the axial direction (C>A−B), the drive transmitter such as the drive-side coupling 90*a* relatively moves within the length of the engaging portion in the axial direction. Thus, the shaft-side drive transmitter is prevented from disengaging from the engaging portion.

To make the movable range (A−B) shorter than the length C of the engaging portion in the axial direction, conceivable approaches include: Approach 1: To shorten the predetermined length A of the coil spring 91; Approach 2: To increase the compressed height B of the coil spring 91; and Approach 3: To increase the length C of the engaging portion in the axial direction.

To shorten the predetermined length A of the coil spring 91 (Approach 1), for example, the E-ring 200 or the step is disposed at a position closer to the drive transmitter than the components such as the ball bearing 186 and a rotator attached to the rotation shaft so that the first end 91E1 of the coil spring 91 contacts the position closer to the drive transmitter than other components attached to the rotation shaft. Approach 1, however, requires processing the rotation shaft to make the groove in which the E-ring 200 is fitted or the step, thus increasing the cost.

To increase the compressed height B of the coil spring 91 (Approach 2), for example, the winding pitch P is reduced to increase the number of turns of wire of the coil spring 91. The spring constant of the coil spring 91, however, is degraded when the winding pitch P is reduced in the entire coil spring 91. Then, the biasing force weakens. Consequently, it is possible that the coil spring 91 fails to push back the drive transmitter with the biasing force to one side in the axial direction. Then, the coupling between the drive transmitter and a driven component (e.g., the driven-side coupling 90*b*) becomes insecure. Then, it is conceivable to increase the diameter of the wire of the coil spring 91 to secure the spring constant even when the winding pitch P is reduced. However, the coil spring 91 becomes bulkier when the wire is thickened. Then, the apparatus can become bulkier.

When the length C of the engaging portion in the axial direction is increased (Approach 3), the durability of the drive transmitter can be weakened.

In view of the foregoing, in Aspect 1, an uneven-pitch coil spring is used to satisfy the relation defined as C>A−B. With the sparse portion of the coil spring in which the winding pitch is wider, the predetermined spring constant is attained, and the coil spring can push the drive transmitter to one side (toward the driven component or to the left in FIG. 6) in the axial direction. That is, the coil spring can bias the drive transmitter to the position where the parallel pin 184*a* (e.g., the shaft-side drive transmitter or the retainer) contacts the back end of the engaging portion.

Additionally, the dense portion having the increased winding pitch can increase the compressed height B compared with a coil spring in which the winding pitch is uniform. This configuration is advantageous in attaining the predetermined biasing force and the compressed height B without increasing the diameter of the wire of the coil spring. Consequently, this configuration can inhibit the increase of the apparatus size and keep the movable range (A−B) of the drive transmitter shorter than the length C of the engaging portion (e.g., the slot 191) in the axial direction (C>A−B). Accordingly, the shaft-side drive transmitter is prevented from disengaging from the engaging portion of the drive transmitter (e.g., the drive-side coupling 90*a*).

Additionally, without increasing the length C of the engaging portion (e.g., the slot 191) in the axial direction or shortening the predetermined length A of the coil spring, the movable range (A−B) of the drive transmitter is made shorter than the length C of the engaging portion in the axial direction. Thus, durability decrease of the drive transmitter is inhibited. Additionally, the first end 91E1 of the coil spring is disposed in contact with the press-fit component such as the ball bearing 186 attached to the rotation shaft, thus obviating the processing to keep the end of the coil spring in contact with the rotation shaft.

Aspect 2

The coil spring according to Aspect 1 includes the sparse portion 91*a* having the first winding pitch $P_1$ and the dense portion 91*b* having the second winding pitch $P_0$ narrower than the first winding pitch $P_1$. In the dense portion 91*b*, the number of turns of wire is three or greater, and adjacent turns of the wire are in contact with each other.

With this configuration, as described above, when the drive transmitter such as the drive-side coupling 90*a* moves in the direction to deform (i.e., compress) the coil spring 91, the sparse portion 91*a* is compressed and has the spring constant to bias the drive transmitter. Accordingly, upon release of an external force to move the drive transmitter in the direction to deform the coil spring 91 against the biasing force of the coil spring 91, the drive transmitter is reliably returned, with the biasing force of the coil spring 91, to the predetermined position (in the above-described embodiment, the position where the parallel pin 184*a* abuts the back end of the slot 191).

Additionally, by setting the number of turns of wire to three or greeter in the dense portions 91*b*, the posture of the coil spring 91 is stabilized even when the coil spring 91 is long. Then, the coil spring 91 can be easily attached to the drive output shaft 184.

Aspect 3

In Aspect 1 or 2, the retainer is the shaft-side drive transmitter such as the parallel pin 184*a*.

With this configuration, the number of components and the cost of the device are reduced compared with a configuration in which a retainer is provided in addition to the shaft-side drive transmitter.

Aspect 4

In any one of Aspects 1 through 3, the first end of the coil spring is disposed in contact with a press-fit component attached to the rotation shaft by press-fit.

This configuration obviates the processing of the rotation shaft and suppresses cost increases compared with the configuration illustrated in FIG. 8, in which the first end of the coil spring 91 is disposed in contact with the step 184*b* on the rotation shaft, and the configuration illustrated in FIG. 9, in which the first end of the coil spring 91 is disposed in contact with the E-ring fitted around the rotation shaft.

Aspect 5

In Aspect 4, the press-fit component attached to the rotation shaft by press-fit is a bearing such as the ball bearing 186.

With this configuration, the number of components and the cost of the device are reduced compared with a configuration in which a press-fit component is provided in addition to the bearing to receive the rotation shaft.

Aspect 6

In any one of Aspects 1 through 6, the drive transmitter such as the drive-side coupling 90*a* includes a tubular part (192) in which the rotation shaft is inserted, and the inner diameter of the tubular part is greater than the outer diameter of the rotation shaft.

This configuration enables smooth insertion of the rotation shaft, such as the drive output shaft 184, to the drive transmitter, such as the drive-side coupling 90*a*, thereby facilitating the assembling.

Aspect 7

An image forming apparatus includes the drive transmission device according to any one of Aspects 1 through 6.

With this configuration, increases in the apparatus cost are suppressed.

Numerous additional modifications and variations are possible in light of the above teachings. It is therefore to be understood that, within the scope of the appended claims, the disclosure of this patent specification may be practiced otherwise than as specifically described herein.

What is claimed is:

1. A drive transmission device comprising:

a rotation shaft;

a drive transmitter attached to the rotation shaft to slide in an axial direction of the rotation shaft, the drive transmitter including an engaging portion extending in the axial direction, the drive transmitter to transmit a drive force from the rotation shaft;

a coil spring including:

a sparse portion having a first winding pitch; and a dense portion having a second winding pitch narrower than the first winding pitch, the coil spring to bias the drive transmitter to one side in the axial direction; and a shaft-side drive transmitter disposed on the rotation shaft, the shaft-side drive transmitter to engage the engaging portion of the drive transmitter to prevent the drive transmitter from disengaging from the rotation shaft due to a biasing force of the coil spring, the coil spring and the engaging portion satisfying a relation defined as:

$$C>A-B$$

where A represents a length of the coil spring in a state in which the shaft-side drive transmitter retains the drive transmitter, B represents a compressed height of the coil spring being compressed to a degree that adjacent winding lines of the coil spring are in contact with each other, and C represents a length of the coil spring in the axial direction.

2. The drive transmission device according to claim 1, wherein a number of turns of a wire is three or greater in the dense portion of the coil spring, and wherein adjacent turns of the wire are in contact with each other in the dense portion of the coil spring.

3. The drive transmission device according to claim 2, wherein the coil spring biases the drive transmitter toward a driven component to be rotated with the drive force transmitted from the rotation shaft, and wherein the engaging portion is a slot that is open at a downstream end in a direction in which the coil spring biases the drive transmitter.

4. The drive transmission device according to claim 3, further comprising a press-fit component attached to the rotation shaft by press-fit, the press-fit component disposed opposite the drive transmitter across the coil spring, wherein an end of the coil spring is in contact with the press-fit component.

5. The drive transmission device according to claim 4, wherein the press-fit component includes a bearing.

6. The drive transmission device according to claim 5, wherein the drive transmitter includes a tubular part in which the rotation shaft is inserted, and wherein an inner diameter of the tubular part is greater than an outer diameter of the rotation shaft.

7. An image forming apparatus comprising the drive transmission device according to claim 6.

8. The drive transmission device according to claim 4, wherein the drive transmitter includes a tubular part in which the rotation shaft is inserted, and wherein an inner diameter of the tubular part is greater than an outer diameter of the rotation shaft.

9. The drive transmission device according to claim 3, wherein the drive transmitter includes a tubular part in which the rotation shaft is inserted, and wherein an inner diameter of the tubular part is greater than an outer diameter of the rotation shaft.

10. The drive transmission device according to claim 2, further comprising a press-fit component attached to the rotation shaft by press-fit, the press-fit component disposed opposite the drive transmitter across the coil spring, wherein an end of the coil spring is in contact with the press-fit component.

11. The drive transmission device according to claim 10, wherein the press-fit component includes a bearing.

12. The drive transmission device according to claim 11, wherein the drive transmitter includes a tubular part in which the rotation shaft is inserted, and wherein an inner diameter of the tubular part is greater than an outer diameter of the rotation shaft.

13. The drive transmission device according to claim 10, wherein the drive transmitter includes a tubular part in which the rotation shaft is inserted, and wherein an inner diameter of the tubular part is greater than an outer diameter of the rotation shaft.

14. The drive transmission device according to claim 2, wherein the drive transmitter includes a tubular part in which the rotation shaft is inserted, and wherein an inner diameter of the tubular part is greater than an outer diameter of the rotation shaft.

15. An image forming apparatus comprising the drive transmission device according to claim 2.

16. The drive transmission device according to claim 1, wherein the coil spring biases the drive transmitter toward a driven component to be rotated with the drive force transmitted from the rotation shaft, and wherein the engaging portion is a slot that is open at a downstream end in a direction in which the coil spring biases the drive transmitter.

17. The drive transmission device according to claim 1, further comprising a press-fit component attached to the rotation shaft by press-fit, the press-fit component disposed opposite the drive transmitter across the coil spring, wherein an end of the coil spring is in contact with the press-fit component.

18. The drive transmission device according to claim 17, wherein the press-fit component includes a bearing.

19. The drive transmission device according to claim 1, wherein the drive transmitter includes a tubular part in which the rotation shaft is inserted, and wherein an inner diameter of the tubular part is greater than an outer diameter of the rotation shaft.

20. An image forming apparatus comprising the drive transmission device according to claim 1.

* * * * *